US009168635B2

(12) United States Patent
Bishop et al.

(10) Patent No.: US 9,168,635 B2
(45) Date of Patent: Oct. 27, 2015

(54) HUMIDITY CONTROL FOR ABRASIVE BLASTING SYSTEMS

(75) Inventors: Stephen Bishop, Dallas, TX (US); Jimmy D. Amerson, Lorena, TX (US); Steven Millican, Hurst, TX (US)

(73) Assignee: Textron Innovations Inc., Providence, RI (US)

( * ) Notice: Subject to any disclaimer, the term of this patent is extended or adjusted under 35 U.S.C. 154(b) by 406 days.

(21) Appl. No.: 13/703,644

(22) PCT Filed: Jul. 14, 2011

(86) PCT No.: PCT/US2011/044044

§ 371 (c)(1), (2), (4) Date: Dec. 12, 2012

(87) PCT Pub. No.: WO2013/009320

PCT Pub. Date: Jan. 17, 2013

(65) Prior Publication Data

US 2013/0143470 A1 Jun. 6, 2013

(51) Int. Cl.

| | |
|---|---|
| ***B24C 1/08*** | (2006.01) |
| ***B24C 3/06*** | (2006.01) |
| ***B24C 7/00*** | (2006.01) |
| ***B24C 5/02*** | (2006.01) |
| ***B24C 1/00*** | (2006.01) |

(52) U.S. Cl.

CPC ... *B24C 7/00* (2013.01); *B24C 1/00* (2013.01); *B24C 3/06* (2013.01); *B24C 5/02* (2013.01); *B24C 7/0053* (2013.01)

(58) Field of Classification Search

CPC ..... B24C 1/00; B24C 1/08; B24C 3/00; B24C 5/02; B24C 7/00; B24C 7/0007; B24C 7/0038; B24C 7/0046; B24C 7/0053; B24C 7/0084

USPC ..... 451/38, 39, 40, 75, 89, 90, 91

See application file for complete search history.

(56) References Cited

U.S. PATENT DOCUMENTS

| | | | |
|---|---|---|---|
| 4,406,505 | A | 9/1983 | Avramovich |
| 6,174,225 | B1 | 1/2001 | Becker |
| 7,101,266 | B2 | 9/2006 | Grechishkin |
| 2008/0176487 | A1 | 7/2008 | Armstrong |
| 2010/0211429 | A1 | 8/2010 | Benson |

FOREIGN PATENT DOCUMENTS

| | | | |
|---|---|---|---|
| JP | 2002120154 | A | 4/2002 |
| WO | 9309915 | A1 | 5/1993 |
| WO | 2006075211 | A2 | 7/2006 |

OTHER PUBLICATIONS

Extended European Search Report dated Feb. 24, 2015 from counterpart EP App. No. 1186943.2.

International Search Report dated Apr. 25, 2012 from counterpart International App. No. PCT/US2011/044044.

Canadian Office Action dated Jan. 23, 2015 from counterpart CA App. No. 2,841,444.

European Examination Report dated Jul. 30, 2015 from counterpart EP App. No. 11869432.2.

*Primary Examiner* — Eileen Morgan

(74) *Attorney, Agent, or Firm* — James E. Walton

(57) ABSTRACT

An abrasive blasting system includes an air subsystem being adapted to provide pressurized air, a fluid subsystem being adapted to provide fluid, a mixer being adapted to mix the fluid with the pressurized air, and a media subsystem being adapted to provide abrasive media. The method includes pressurizing the air, mixing the fluid with the air, thereby changing the relative humidity of the air, and blasting a surface of a structure with abrasive media mixed with the fluid and the pressurized air.

9 Claims, 3 Drawing Sheets

HUMIDITY CONTROL FOR ABRASIVE BLASTING SYSTEMS

TECHNICAL FIELD

The present application relates generally to manufacturing systems, and more particularly to abrasive blasting systems.

DESCRIPTION OF THE PRIOR ART

Grit-blasting, abrasive blasting, and sandblasting are well known processes in the art for propelling a high pressure stream of abrasive material on a surface, which can either form a smooth surface, a rough surface, or a contoured surface. A problem commonly associated with the abrasive blasting system is electrostatic buildup created by the interaction of the abrasive material and surface applied thereto. The electrostatic buildup could result in serious harm to the worker and/or irreparable damage to the structure.

Conventional methods to reduce the electrostatic buildup include increasing the relative humidity of the air, on a global scale, within the facility housing the abrasive blasting system. For example, a humidity control system and/or a HVAC system can be utilized to increase the relative humidity of the air, thereby reducing the likelihood of electrostatic buildup. However, such features are not ideal in most scenarios due to the increased costs associated with continuously running and maintaining the HVAC system.

Although the foregoing developments represent great strides in the area of reducing electrostatic buildup, many shortcomings remain.

BRIEF DESCRIPTION OF THE DRAWINGS

The novel features believed characteristic of the application are set forth in the appended claims. However, the application itself, as well as a preferred mode of use, and further objectives and advantages thereof, will best be understood with reference to the following detailed description when read in conjunction with the accompanying drawings, wherein:

Figure 1:
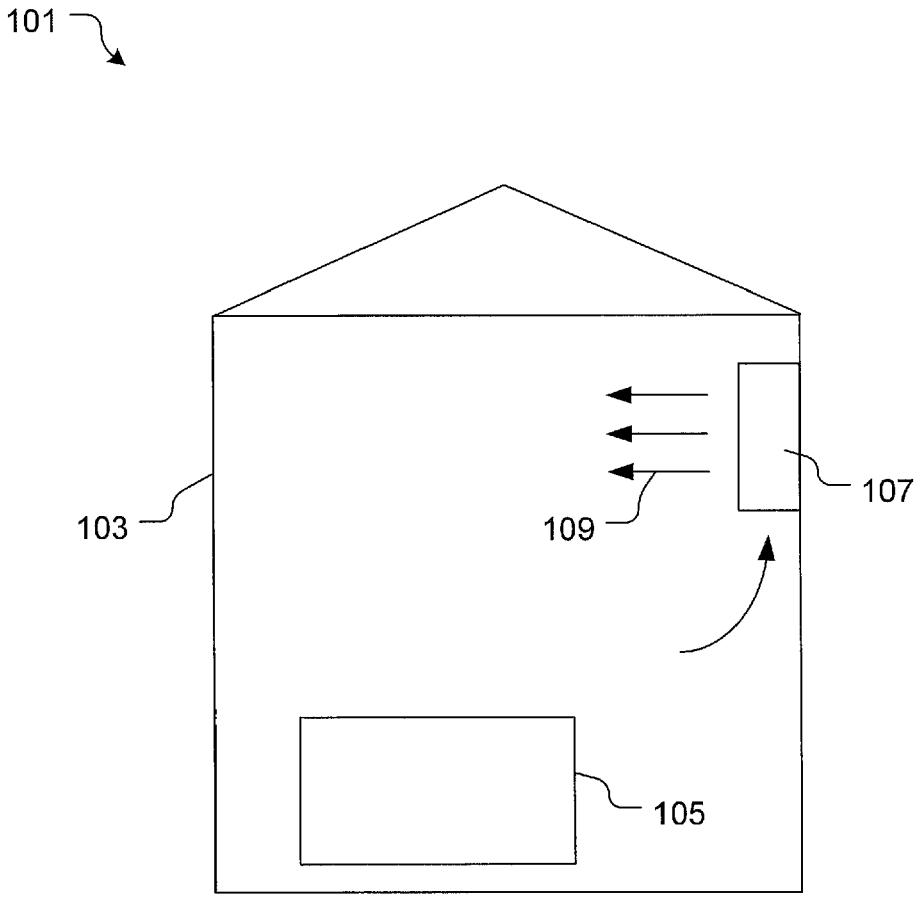
FIG. 1 (Prior Art)
FIG. 1 is a front view of a facility having a conventional abrasive blasting system.

While the system and method of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the process of the present application as defined by the appended claims.

DESCRIPTION OF THE PREFERRED EMBODIMENT

The system and method of the present application greatly reduces, if not eliminates, static buildup during abrasive blasting. Specifically, the abrasive blasting system utilizes a fluid subsystem adapted to locally increase the relative humidity of the air passing through the abrasive blasting system. The system is further provided with a relative humidity control subsystem in communication with the air, which constantly monitors and regulates the relative humidity. Furthermore, the system is optionally provided with a grounding subsystem adapted to electrically ground the blasted structure, thus further reducing the possibility of electrostatic buildup. In one embodiment, the abrasive blasting system is portable, thereby enabling a worker transport the system to the location of use.

It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Referring now to the drawings, FIG. 1 depicts a conventional system 101 utilized to reduce electrostatic buildup during the abrasive blasting process. In the exemplary embodiment, a facility 103 stores a conventional blasting system 105 therein. Prior to blasting, a HVAC and/or humidity regulator system 107 regulates the relative humidity of the air, on a global scale, within facility 103. For clarity, a plurality of arrows 109 depict the continuous circulation of air through the HVAC system 107 and facility 103.

FIG. 1 provides clarification of some problems commonly associated with conventional blasting systems. In particular, HVAC system 107 regulates the relative humidity of the air by continuously recycling the large body of air within facility 103. In most large facilities, this process is very time consuming and costly. In addition, the HVAC system must cycle the majority, if not all, the air prior to blasting, which requires considerable time prior to operation.

Another common problem associated with system 101 is creating uniform relative humidity within the facility. For example, a large facility could include areas wherein the outside air enters through one or more entrances, i.e., a door left ajar, windows, crevices, and/or any other type of entrance, which greatly changes the relative humidity around these areas. It is difficult, if not impossible, to regulate the relative humidity in larger facilities without the use of large energy consuming HVAC systems. The abrasive blasting system of the present application overcomes these problems by locally changing the relative humidity of the air entering the system. Further illustration and description of the preferred embodiment of the abrasive blasting system is provided below.

Figure 2:
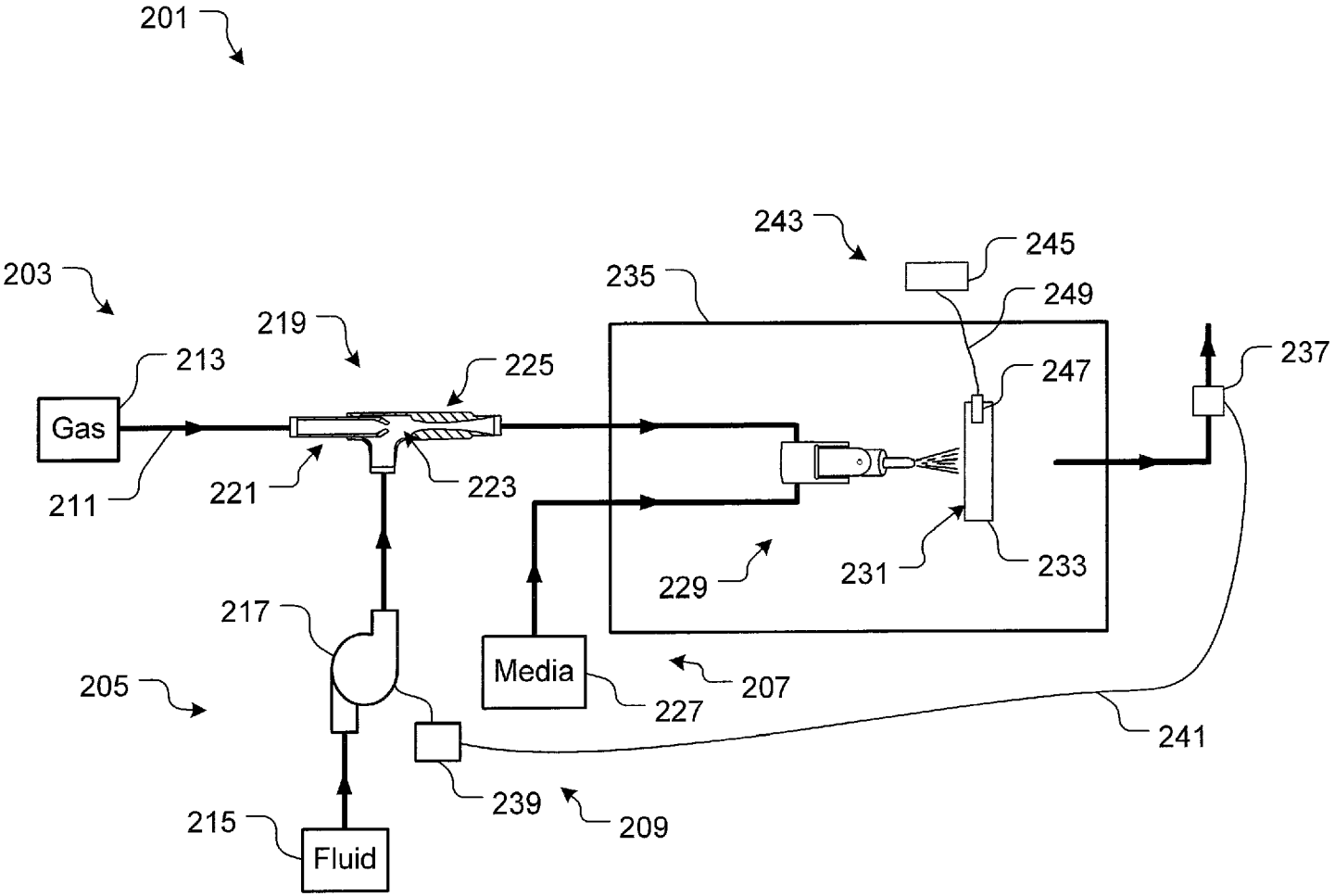
FIG. 2 is a schematic view of an abrasive blasting system according to the preferred embodiment of the present application.

FIG. 2 shows a schematic view of an abrasive blasting system 201 according to the preferred embodiment of the present application. Abrasive blasting system 201 comprises one or more of an air subsystem 203, a fluid subsystem 205, an abrasive media subsystem 207, and a control subsystem 209. Abrasive blasting system 201 is further provided with a plurality of conduits 211 utilized to interconnect the subsystems disclosed herein. It should be noted that for simplicity, a single conduit 211 is identified, and for clarity, a plurality of arrows are provided within the plurality of conduits 211 to depict the movement of air, fluid, and abrasive media channeled therein.

Air subsystem 203 includes a compressor 213 utilized to compress air at predetermined pressure and adapted to direct the air through one or more of the plurality of conduits 211 in communication thereto. In the preferred embodiment, abrasive blasting system 201 utilizes air; however, it should be appreciated that alternative embodiments could utilize other forms of suitable gases for the abrasive blasting process.

Fluid subsystem 205 includes a fluid reservoir 215 for storing fluid therein. It should be understood that the fluid from fluid reservoir 215 is utilized to change the relative humidity of the air from air subsystem 213. In the preferred embodiment, the fluid is water; however, alternative embodiments could utilize other different types of suitable fluids adapted to change the relative humidity. Fluid subsystem 205 further includes a pump 217 adapted to pressurize the fluid and adapted to direct the fluid to a mixer 219. Pump 217 is preferably adjustable to provide a desired flow rate, thereby enabling changes to the relative humidity.

Mixer 219 is adapted to mix air from air subsystem 203 with fluid from fluid subsystem 205. During operation, air enters mixer 219 through a first chamber 221 having inner walls that taper to increase the air velocity of the air passing therethrough. The fluid enters mixer 219 via a second chamber 223 in fluid communication with chamber 221. Second chamber 223 is utilized to mix the air with the fluid. The mixed air and fluid is further turbulently mixed through a third section 225 adapted compress then expand the fluidly mixed air. Thereafter, the treated air is mixed downstream with the abrasive media from media subsystem 207.

Media subsystem 207 includes a chamber 227 for storing abrasive media utilized during the abrasive blasting process. The abrasive media is channeled through one or more of the plurality of conduits 211 to an abrasive blasting gun 229. During operation, air, fluid, and media are channeled to gun 229 via the plurality of conduits 211, which in turn blasts the abrasive media on a surface 231 of a structure 233.

A housing 235 is utilized to hold gun 229 and structure 233 therein and to provide means for containing the blasted abrasive media. One or more of the plurality of conduits 211 are utilized to channel exiting air from chamber 235. A sensor 237 is in communication with the exiting air and is utilized to sense the relative humidity of the exiting air. Thereafter, sensor 237 relays the sensed relative humidity to a control station 239 via an electrical conductor 241. Based upon the sensed relative humidity, control station 239 adjusts the flow rate of fluid entering mixer 219 by either decreasing or increasing the pump output. It has been observed that the desired relative humidity is approximately 40-50 RH in most applications for eliminating static buildup. It should be appreciated that control subsystem 207 and fluid subsystem 205 are adapted to regulate the relative humidity of abrasive blasting system 201 to any desired relative humidity. It will also be appreciated that sensor 237 is adapted to continuously provide real time data to control station 239, thus allowing continuous adjustment of fluid subsystem 215 such that the desired relative humidity is maintained throughout the blasting process.

Abrasive blasting system 201 is further provided with grounding subsystem 243 adapted to further reduce the likelihood of electrostatic buildup. Grounding subsystem 243 includes a grounded structure 245 conductively coupled to an attachment device 247, which in turn is attached to structure 233 via a conductor 249. During operation, the combination of changing the relative humidity and grounding the structure greatly reduces, if not eliminates, the likelihood of electrostatic buildup.

Figure 3:
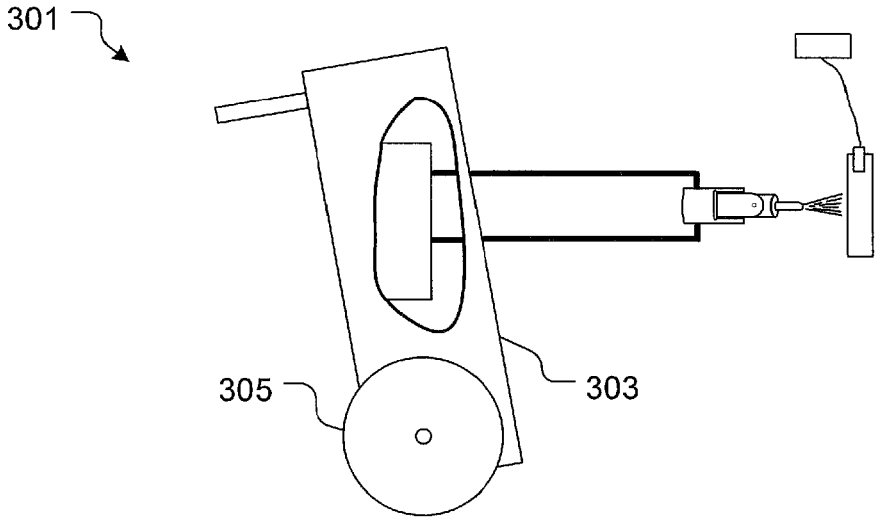
FIG. 3 is a side view of an alternative embodiment of the abrasive blasting system of FIG. 2.

Referring to FIG. 3 in the drawings, an alternative embodiment of abrasive blasting system 201 is shown. Abrasive blasting system 301 is substantially similar in function to abrasive blasting system 201. In particular, system 301 is adapted to reduce electrostatic buildup during the blasting process. It should be understood that abrasive blasting system 301 includes all features of abrasive blasting system 201 and is further provided with a portable structure 303, which enables abrasive blasting system 301 to perform blasting operations in the field. For example, abrasive blasting system 301 could easily be transported to the field for blasting a surface, i.e., a side panel, of a vehicle. In the exemplary embodiment, portable structure 303 is portable per a set of wheels 305 rotatably attached to structure 303; however, it should be appreciated that alternative embodiments could include different structures, for example, a towable trailer, in lieu of the exemplary embodiment.

Figure 4:
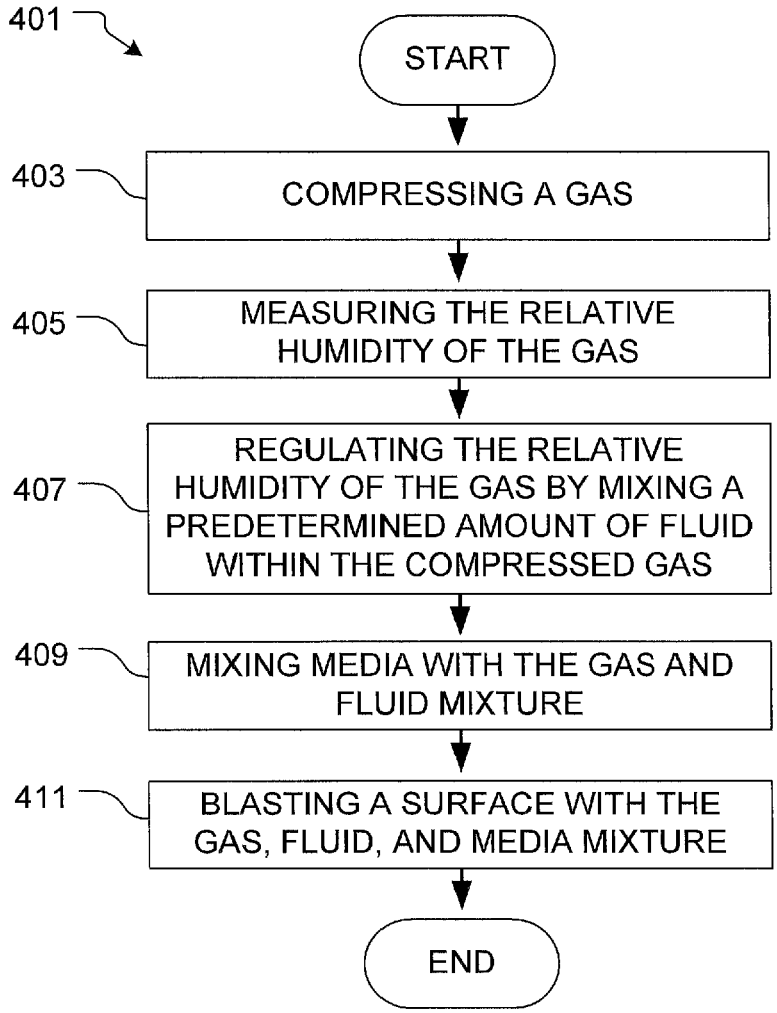
FIG. 4 is a flow chart depicting the preferred method to reduce electrostatic buildup during the abrasive blasting process.

Referring now to FIG. 4 in the drawings, a flow chart 401 depicting the preferred abrasive blasting process is shown. Box 403 shows the first step of the process, which includes pressuring the air. This feature is preferably achieved via an air compressor. The next step includes regulating the relative humidity of the air, as depicted in boxes 405 and 407. This feature is preferably achieved via the fluid subsystem and control subsystem disclosed herein. Thereafter, the abrasive media is mixed with the fluidly compressed air and subsequently blasted on a surface, as depicted in boxes 409 and 411. The preferred method is further optionally provided with the process of grounding the structure to reduce the possibility of electrostatic buildup.

It is apparent that a system and method having significant advantages has been described and illustrated. The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the invention. Accordingly, the protection sought herein is as set forth in the description. Although the present embodiments are shown above, they are not limited to just these embodiments, but are amenable to various changes and modifications without departing from the spirit thereof.

The invention claimed is:

1. A portable abrasive blasting system, comprising:
- an air subsystem being adapted to provide pressurized air;
- a fluid subsystem being adapted to provide fluid;
- a mixer being adapted to combine and mix the fluid with the pressurized air, thus changing the relative humidity of the pressurized air;
- a media subsystem being adapted to provide abrasive media; and
- a control subsystem, having:
  - a sensor in communication with the pressurized air, the sensor being adapted to sense the relative humidity of the pressurized air; and
  - a control station operably associated with the fluid subsystem and in data communication with the sensor;
  - wherein the control subsystem is adapted to regulate the relative humidity of pressurized air;
- wherein the abrasive media mixes with the pressurized air and the fluid;
- wherein the abrasive media is subsequently blasted on a surface of a structure; and
- wherein the portable structure is adapted to carry the air subsystem, the fluid subsystem, the mixer, the control subsystem, and the media subsystem to the place of use.

2. The portable abrasive blasting system of claim 1, further comprising:
- a grounding subsystem, having:
  - a grounded structure; and
  - an attachment device being attached to the structure and being conductively coupled to the grounded structure via an electrical conductor.

3. The portable abrasive blasting system of claim 1, the fluid subsystem comprising:
- a pump being adapted to provide a flow rate of fluid to the mixer, the pump being operably associated with the control station such that the control station adjusts the flow rate based upon the sensed relative humidity of the air.

4. The portable abrasive blasting system of claim 1, the fluid subsystem comprising:

a pump being adapted to provide fluid to the mixer.

5. The portable abrasive blasting system of claim 1, the mixer comprising:

a first chamber in communication with the air subsystem, the first chamber being adapted to increase the air velocity of the air entering therein;

a second chamber in communication with the first chamber and in fluid communication with the fluid subsystem, the second chamber being adapted to mix the pressurized air with the fluid; and a third chamber in fluid communication with a the second chamber, the second chamber being adapted to contract and then expand the air and the fluid channeled therethrough.

6. A method to reduce electrostatic buildup during abrasive blasting on a surface of a structure, the method comprising:

pressurizing air with an air subsystem;

sensing the relative humidity of the pressurized air with a control subsystem;

mixing fluid with the pressurized air with a mixer;

regulating the amount of fluid mixed with the pressurized air based upon the sensed relative humidity;

mixing abrasive media with the pressurized air mixed with the fluid; and blasting the surface of the structure with abrasive media mixed with the fluid and the pressurized air;

wherein the process of regulating the amount of fluid is further achieved by:

sensing of the relative humidity of the pressurized air with a sensor;

relaying the sensed relative humidity to a control station operably associated with the adjustable pump; and adjusting the flow rate of fluid from the pump with the control station based upon the sensed relative humidity.

7. The method of claim 6, wherein the regulating of the amount of fluid is achieved by controlling the flow rate of the fluid with an adjustable pump.

8. The method of claim 6, further comprising:

transporting the air subsystem, the control subsystem, the mixer, and the abrasive media via a portable structure to the surface of the structure.

9. The method of claim 6, further comprising:

electrically grounding the structure with a grounding subsystem.

* * * * *